US005699777A

United States Patent [19]

Kawasaki et al.

[11] Patent Number: 5,699,777

[45] Date of Patent: Dec. 23, 1997

[54] FUEL SUPPLYING SYSTEM FOR VERTICAL ENGINE WITH MULTIPLE CYLINDERS

[75] Inventors: Naoki Kawasaki, Hamamatsu; Mitsuhiko Ohta, Shizuoka-ken; Toshiaki Ikeya, Hamamatsu, all of Japan

[73] Assignee: Suzuki Kabushiki Kaisha, Shizuoka-ken, Japan

[21] Appl. No.: 723,840

[22] Filed: Sep. 30, 1996

[30] Foreign Application Priority Data

Nov. 30, 1995 [JP] Japan ..... P7-312858

[51] Int. Cl.[6] ..... F02B 13/00

[52] U.S. Cl. ..... 123/580

[58] Field of Search ..... 123/579, 580; 261/23.2, 36.2

[56] References Cited

U.S. PATENT DOCUMENTS 4,019,477 4/1977 Overton ..... 123/579

5,326,293 7/1994 Shishido et al. ..... 123/580

5,450,831 9/1995 Fukuoka ..... 123/580

5,517,977 5/1996 Nakai et al. ..... 123/580

*Primary Examiner*—Erick R. Solis

*Attorney, Agent, or Firm*—Finnegan, Henderson, Farabow, Garrett & Dunner, L.L.P.

[57] ABSTRACT

A fuel supplying system for a vertical engine provided with multiple cylinders arranged in a vertical direction, respectively, in an installed state of the engine and a crankshaft disposed vertically therein, comprising a plurality of fuel supplying means disposed for the cylinders, respectively, said fuel supplying means being divided into plurality of groups. A plurality of fuel pumps each disposed for each of said groups of the fuel supplying means, said fuel pumps being arranged below the fuel supplying means at a lowest position of the corresponding each group of the fuel supplying means. Further, a plurality of fuel diverging means operatively connecting the fuel pumps to the each group of the fuel supplying means, respectively, said fuel diverging means being connected to each other through connecting means.

4 Claims, 3 Drawing Sheets

FUEL SUPPLYING SYSTEM FOR VERTICAL ENGINE WITH MULTIPLE CYLINDERS

BACKGROUND OF THE INVENTION

The present invention relates to a fuel supplying system for a vertical engine with multiple cylinders having a crankshaft disposed vertically and is particularly concerned with the fuel supplying system which supplies fuel to fuel supplying means provided for each cylinder of the engine.

FIG. 3A shows a left side view of the conventional vertical engine with multiple cylinders, and FIG. 3B shows its rear view.

As shown in FIGS. 3A and 3B, an engine 50 is an in-line-four-cylinder vertical engine used in, for example, an onboard engine. A crankshaft, not shown, is arranged vertically inside the engine 50, and four cylinders are arranged vertically as well. A total of four carburetors 51 54 are provided for each cylinder, and these four carburetors 51 54 are the fuel supplying means for the engine 50.

Further, a fuel pump 55 is disposed approximately in the central portion of the rear of the engine 50. There are two manifold-type fuel diverging pipes 56,57 extending from the fuel pump 55. One of the fuel diverging pipes 56 is connected to the two of the upper carburetors 51,52, and the other one of the fuel diverging pipes 57 is connected to the two of the lower carburetors 53,54, respectively.

Furthermore, a fuel supplying pipe 59 is connected to the fuel pump 55 through a fuel filter 58.

As described above, a fuel supplying system 60 is composed with four carburetors 51 54, one fuel pump 55, two fuel diverging pipes 56,57, one fuel filter 58, one fuel supplying pipe 59, and some others.

The fuel pump 55 pumps up the fuel which is filtered by the fuel filter 58, and press-feeds the fuel into each carburetors 51 54 through the fuel diverging pipes 56,57 to make the engine 50 in operation.

However, the fuel supplying system 50 described above has following problems.

First, because there is only one fuel pump 55 disposed approximately in the central portion of the rear of the engine 50, locations of the two lower carburetors 53,54 becomes below the fuel pump 55.

In this circumstances, when bubbles are generated inside the lower fuel diverging pipe 57 by the influence of the heat from the engine, the flow of the fuel inside the fuel diverging pipe 57 will be disturbed by the vapor-lock condition. This will cause an insufficient fuel supply to the two lower carburetors 53,54, and will end up in the condition of the engine failure.

On the other hand, for the two upper carburetors 51,52, the fuel diverging pipe 56 is extended horizontally or upwardly from the fuel pump 55 so that the bubbles generated inside the fuel diverging pipe 56 will not disturb the fuel flow therein, and sufficient amount of fuel will be supplied to the two upper carburetors 51,52.

Suppose the fuel pump 55 is located below the lower most carburetor 54, then it may be possible to supply sufficient fuel to two lower carburetors 53,54 even when the bubbles generated inside the fuel diverging pipe 57. However, the length of the upper fuel diverging pipe 56 will become considerably long, which makes anxiety about the fuel supply to the two upper carburetors 51,52 may be insufficient.

Moreover, this fuel supplying system is designed to supply fuel to all the carburetors 51 54 by using only single fuel pump 55. Therefore, the continuous operation of the engine 50 will become impossible when the fuel pump 55 fails during the engine 50 is in operation.

Furthermore, because the only single fuel pump 55 must supply fuel to all the carburetors 51 54, the size of the fuel pump 55 tends to be large, therefore, the nature of the layout around the engine 50 becomes unsatisfied.

Especially, since the engine 50 used of the onboard engine is surrounded by the casing, there are not enough spaces around the engine 50 to locate equipments, therefor the large sized fuel pump 55 is not quite advantageous.

SUMMARY OF THE INVENTION

An object of the present invention is to substantially eliminate defects or drawbacks encountered in the prior art described above and to provide a fuel supplying system for a vertical engine with multiple cylinders which enables to supply fuel to pluralities of fuel supplying means evenly and stably, as well as to improve the nature of the layout around the engine.

Another object of the present invention is to make an continuous operation of the engine possible by making up the failure of the fuel pump.

These and other objects can be achieved according to the present invention by providing a fuel supplying system for a vertical engine provided with multiple cylinders arranged in a vertical direction, respectively, in an installed state of the engine and a crankshaft disposed vertically therein, comprising:

a plurality of fuel supplying means disposed for the cylinders, respectively, the fuel supplying means being divided into plurality of groups;

a plurality of fuel pumps each disposed for each of the groups of the fuel supplying means, the fuel pumps being arranged below the fuel supplying means at a lowest position of the corresponding each group of the fuel supplying means; and a plurality of fuel diverging means operatively connecting the fuel pumps to the each group of the fuel supplying means, respectively, the fuel diverging means being connected to each other through connecting means.

In preferred embodiments, the connecting means comprises a base portion connecting pipe which connects base portions of the diverging means near the fuel pumps and a diverging portion connecting pipe which connects diverging portions of the fuel diverging means. Further, the fuel supplying means are carburetors, and the fuel diverging means are manifold-type fuel diverging pipes.

According to the fuel supplying system for a vertical engine with multiple cylinders of the present invention of the characters described above, the fuel diverging means, pipes, for example, will be extended horizontally or upwardly from two fuel pumps to each of the fuel supplying means, carburetors for example. Therefor even if the bubbles are generated inside the fuel diverging pipes the vapor-lock condition will not take place because the directions of the bubble flow and the fuel flow are the same. As a result, it is possible to supply sufficient fuel to each and every carburetors.

Moreover the fuel supplying system is designed to supply fuel by using pluralities of fuel pumps, the sizes of the fuel pumps may become smaller than using only one fuel pump. Therefore, it is possible to locate the fuel pumps on the engine even if there are not enough spaces around the engine, and it will improve the nature of the layout around the engine.

Further, since the fuel diverging pipes are connected by the connecting means, pipes for example, the fuel from one of the fuel pumps will be supplied to all the carbureters through the connecting pipes when the other one of the fuel pump fails. Therefore, the continuous operation of the engine will be made possible by making up the failure of the fuel pump.

Furthermore, since both upper streams and lower streams of the fuel diverging pipes are connected by the connecting pipes, the fuel flow resistance may be reduced when supplying fuel to all the carbureters by using a single fuel pump, and will result to diminish the apprehension of the insufficient fuel supply.

The further nature and features of the present invention will be made more clear hereunder through descriptions with reference to the accompanying drawings.

DESCRIPTION OF THE PREFERRED EMBODIMENT

One embodiment of the present invention will be described hereunder with reference to the accompanying drawings.

Figure 1:
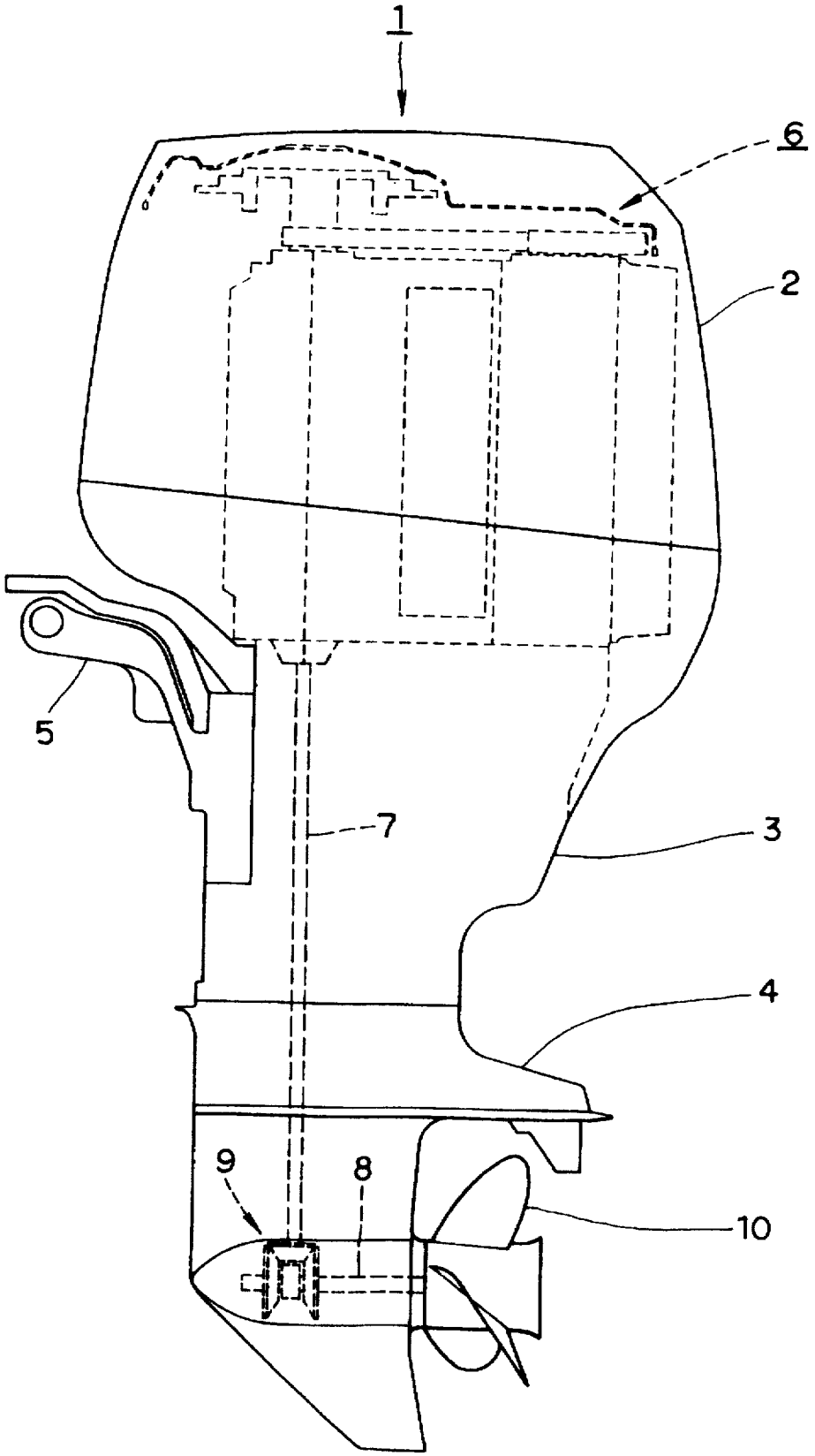
FIG. 1 is a general left side view of an onboard engine that the fuel supplying system to which the present invention is applicable.

FIG. 1 shows the general left side view of an onboard engine which a fuel supplying system of the present invention is applied.

As shown in FIG. 1, the onboard engine 1 comprises an upper casing 2, which is disposed in upper most position, a middle casing 3 disposed below the upper casing 2, and the lower casing 4 disposed below the middle casing 3.

A portion of the middle casing 3 is mounted to the tail end of a boat through a cramp bracket 5, and the onboard engine 1 is swingable sideways around the cramp bracket 5.

A vertical in-line-four-cylinder engine 6 is disposed inside the upper casing 2. A drive shaft 7 is extending downwardly from the engine 6 and passes through the middle casing 3. The drive shaft 7 drives a propeller shaft 8, which is supported by the lower casing 4, through bevel gears 9, and revolves a propeller 10 which is mounted at the rear end of the propeller shaft 8.

Figure 2A:
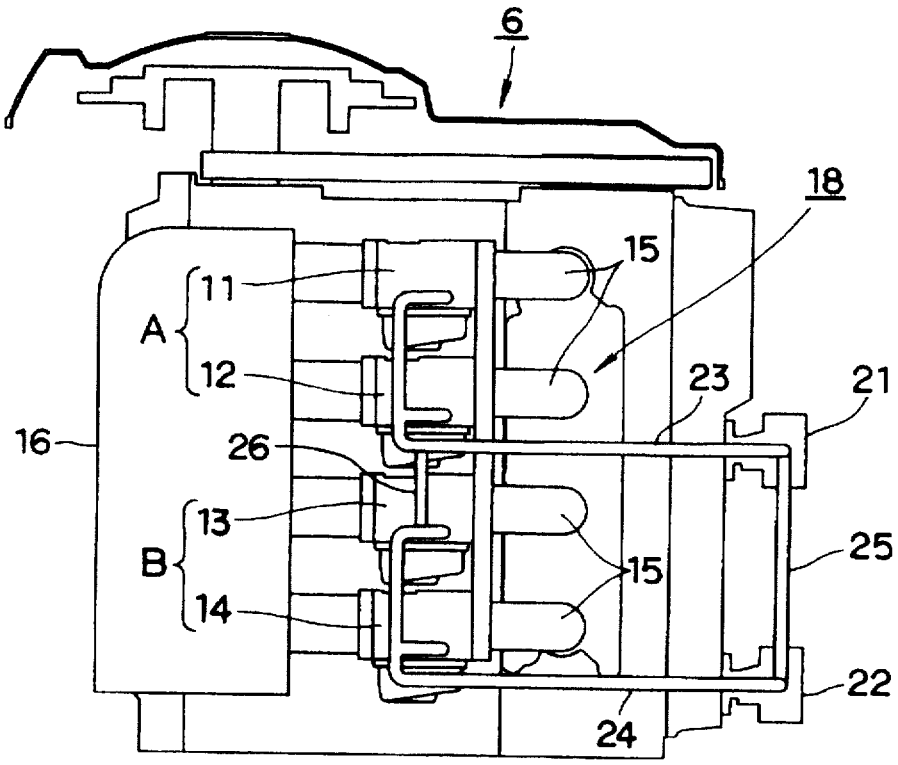
FIG. 2A is a left side view of an engine representing one embodiment relating to the present invention.
Figure 2B:
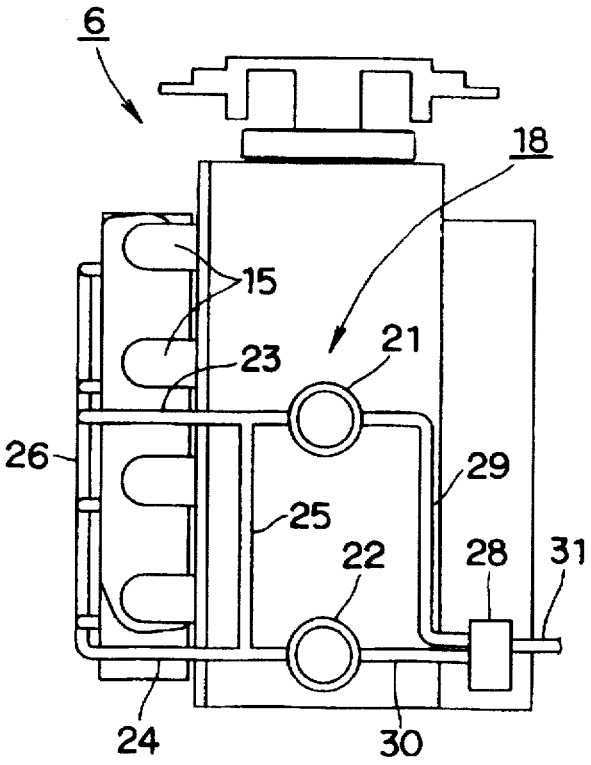
FIG. 2B is a rear view of the engine shown in FIG. 2A.
Figure 3A:
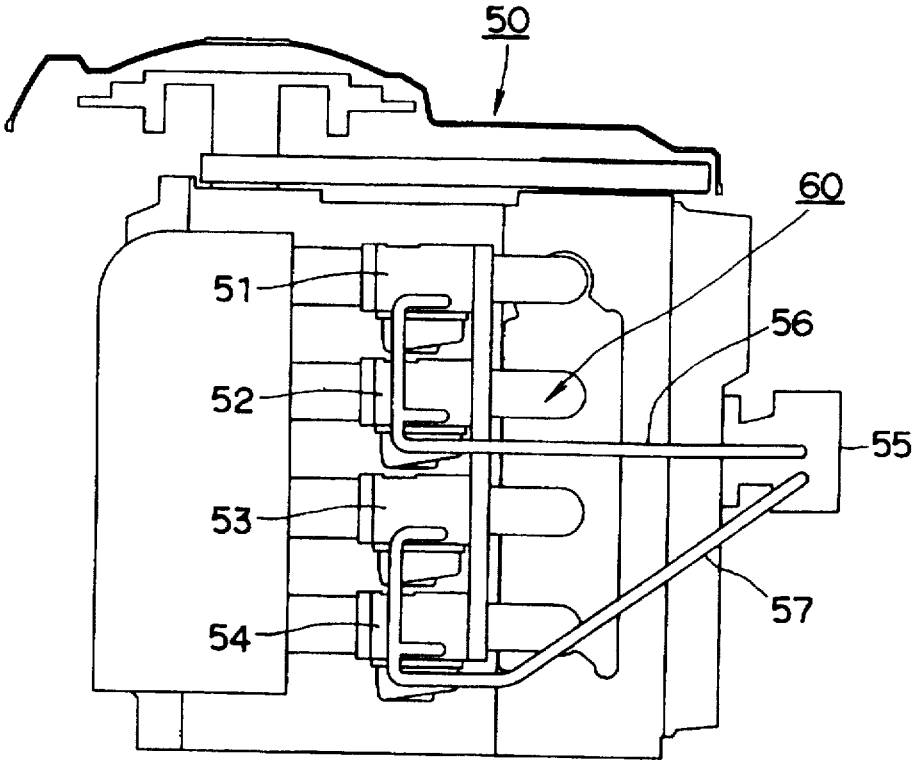
FIG. 3A PRIOR ART
FIG. 3A is a left side view of the conventional vertical engine with multiple cylinders.
Figure 3B:
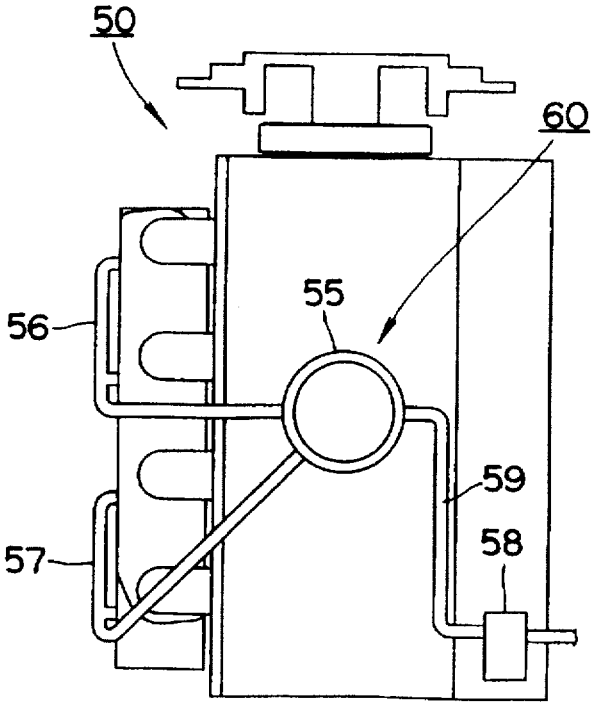
FIG. 3B PRIOR ART
FIG. 3B is a rear view of the engine shown in FIG. 3A

FIG. 2A shows a left side view of the engine 6, and FIG. 2B shows a rear view of the engine 6.

As shown in FIGS. 2A and 2B, a crankshaft, not shown, is disposed vertically in the engine 6, and four cylinders are disposed vertically, as well. Carburetors 11 14 are connected to each cylinder through inlet pipes 15. Further, a surge tank 16 is connected to the intake portion of the carburetors 11 14.

A fuel supplying system 18 that supplies the fuel to each cylinder of the engine 6 is a composition of the followings including the carburetors 11 14 mentioned above as a fuel supplying means.

The four carburetors 11 14 are divided into two groups, namely a group A and a group B. The group A consists the two of the upper carburetors 11 and 12, and the group B consists the two of the lower carburetors 13 and 14.

There is one each out of two fuel pumps 21,22 arranged to the groups A and B respectively. The fuel pumps 21,22 are mounted on the back side of the engine 6 lining in vertical direction, for example.

The upper fuel pump 21 is located below the lower most carburetor 12 of the group A, while the lower fuel pump 22 is located below the lower most carburetor 14 of the group B.

Further, a manifold-type fuel diverging pipe 23 extending from the upper fuel pump 21 is connected to the carburetors 11,12 of the group A,and another manifold-type fuel diverging pipe 24 extending from the lower fuel pump 22 is connected to the carburetors 13,14 of the group B.

Furthermore, both of the fuel diverging pipes 23,24 are connected by connecting pipes, i.e. a base portion connecting pipe 25 and a diverging portion connecting pipe 26.

The base portion connecting pipe 25 is connecting the base portions, i.e. the fuel pump 21,22 sides of the fuel diverging pipes 23,24, and the diverging portion connecting pipe 26 is connecting the diverging portions of the fuel diverging pipes 23,24.

Further, a fuel filter 28 is mounted on the lower most portion of the back side of the engine 6, and two fuel supplying pipes 29,30 extending from the fuel filter 28 are connected to each fuel pumps 21,22. Furthermore, another fuel supplying pipe 31 extending from a fuel tank, not shown, is connected to the fuel filter 28.

The fuel supplying system 18 is composed as described above.

For the engine 6 to be in operation, the upper and lower fuel pumps 21,22 pump up the fuel which is filtered by the fuel filter 28. Then the upper fuel pump 21 press-feeds the fuel into the carburetors 11,12 of the group A through the fuel diverging pipe 23, while the lower fuel pump 22 press-feeds the fuel into the carburetors 13,14 of the group B through the fuel diverging pipe 24.

When composing the fuel supplying system 18 as described above, the fuel diverging pipes 23,24 will be extended horizontally or upwardly from two fuel pumps 21,22 to each of the carburetors 11 14. Therefor even if the bubbles are generated inside the fuel diverging pipes 23,24, the vapor-lock condition will not take place because the directions of the bubble flow and the fuel flow are the same. As a result, it is possible to supply sufficient fuel to each and every carburetors 11 14.

Moreover the fuel supplying system is designed to supply fuel by using two fuel pumps 21,22, the sizes of the fuel pumps 21,22 may become smaller than using only one fuel pump. Therefore, it is possible to locate the fuel pumps 21,22 on the engine 6 even if there are not enough spaces between the engine 6 and the upper casing 2, and it will improve the nature of the layout around the engine 6.

Further, since the fuel diverging pipes 23,24 are connected by the connecting pipes, namely the base portion connecting pipe 25 and the diverging portion connecting pipe 26, the fuel from one of the fuel pumps will be supplied to all the carbureters 11 14 through the connecting pipes 25,26 when the other one of the fuel pump fails. Therefore, the continuous operation of the engine 6 will be made possible by making up the failure of the fuel pump.

Especially, since both upper streams and lower streams of the fuel diverging pipes 23,24 are connected by the connecting pipes, the fuel flow resistance may be reduced when supplying fuel to all the carbureters 11 14 by using a single fuel pump, and will result to diminish the apprehension of the insufficient fuel supply.

Now, although the engine 6 applied in this embodiment is the in-line-four-cylinder vertical engine, the fuel supplying system 18 of the present invention may be applicable to any kind of vertical engines, such as V-type engines or opposed-cylinder type engines.

Further, the applications of the fuel supplying system 18 of the present invention are not limited only for use in the onboard engine, but for any other purposes.

Furthermore, the fuel supplying means are not limited to the carbureters, but a fuel injection system, for example, may be used.

It is to be noted that the present invention is not limited to the described embodiment and many other modifications and changes may be made without departing from the scope of the appended claims.

What is claimed is:

1. A fuel supplying system for a vertical engine provided with multiple cylinders arranged in a vertical direction, respectively, in an installed state of the engine and a crankshaft disposed vertically therein, comprising:

a plurality of fuel supplying means disposed for the cylinders, respectively, said fuel supplying means being divided into plurality of groups;

a plurality of fuel pumps each disposed for each of said groups of the fuel supplying means, said fuel pumps being arranged below the fuel supplying means at a lowest position of the corresponding each group of the fuel supplying means; and a plurality of fuel diverging means operatively connecting the fuel pumps to the each group of the fuel supplying means, respectively, said fuel diverging means being connected to each other through connecting means.

2. A fuel supplying system for a vertical engine with multiple cylinders according to claim 1, wherein said connecting means comprises a base portion connecting pipe which connects base portions of the diverging means near the fuel pumps and a diverging portion connecting pipe which connects diverging portions of said fuel diverging means.

3. A fuel supplying system for a vertical engine with multiple cylinders according to claim 1, wherein said fuel supplying means are carburetors.

4. A fuel supplying system for a vertical engine with multiple cylinders according to claim 1, wherein said fuel diverging means are manifold-type fuel diverging pipes.

* * * * *